US005519782A

United States Patent [19]

Shinohara et al.

[11] Patent Number: 5,519,782

[45] Date of Patent: May 21, 1996

[54] HEADPHONE

[75] Inventors: Ikuo Shinohara, Tokyo; Kenichi Katayama; Mitsuhiro Nakamura, both of Kanagawa, all of Japan

[73] Assignee: Sony Corporation, Tokyo, Japan

[21] Appl. No.: 304,418

[22] Filed: Sep. 12, 1994

Related U.S. Application Data

[63] Continuation of Ser. No. 36,154, Mar. 24, 1993, abandoned.

[30] Foreign Application Priority Data

| | | | |
|---|---|---|---|
| Mar. 30, 1992 | [JP] | Japan | 4-103732 |
| Mar. 30, 1992 | [JP] | Japan | 4-103733 |
| Oct. 13, 1992 | [JP] | Japan | 4-300276 |

[51] Int. Cl.[6] ..... H04R 25/00

[52] U.S. Cl. ..... 381/183; 381/187

[58] Field of Search ..... 381/183, 187, 381/23.1, 205, 68.6, 182, 188; 379/430; 181/129, 137, 135

[56] References Cited

U.S. PATENT DOCUMENTS

| | | | |
|---|---|---|---|
| 4,403,120 | 9/1983 | Yoshimi | 381/187 |
| 4,736,435 | 4/1988 | Yokoyama et al. | 381/187 |
| 5,048,092 | 9/1991 | Yamagishi et al. | 381/68.6 |

FOREIGN PATENT DOCUMENTS

| | | | |
|---|---|---|---|
| 0372883 | 6/1990 | European Pat. Off. . | |
| 3210034 | 9/1982 | Germany . | |
| 3306629 | 9/1983 | Germany | 381/183 |
| 3420297 | 12/1984 | Germany | 381/183 |
| 2232849 | 12/1990 | United Kingdom . | |

*Primary Examiner*—Curtis Kuntz
*Assistant Examiner*—Sinh Tran
*Attorney, Agent, or Firm*—Jay H. Maioli

[57] ABSTRACT

A headphone includes a pair of housing members into which speaker units and diaphragms are accommodated, protector members having sound radiating portions on which a plurality of sound radiating apertures are bored and respectively provided on the pair of housing members at their sound radiation sides from which sound is radiated by a vibration of the diaphragms, and supporting members for supporting the housing members within a cavum concha of an auricle of a listener's ear so that the sound radiating portion is opposed to the entrance of an external auditory meatus in the auricle of the listener's ear, wherein the housing member has a concave portion that is engaged with one portion of the auricle of the listener's ear when the housing member is fitted into the auricle of the listener's ear.

3 Claims, 11 Drawing Sheets

HEADPHONE

This is a continuation of application Ser. No. 08/036,154 filed Mar. 24, 1993 now abandoned.

BACKGROUND OF THE INVENTION

1. Field of the Invention

The present invention generally relates to headphones and, more particularly, is directed to a headphone which can be closely fitted into a cavum concha of a listener's ear to prevent sound from escaping to the outside to thereby improve acoustic characteristics thereof.

2. Description of the Prior Art

A headphone of a so-called vertical-in-the ear type has hitherto been proposed, in which a housing portion having a sound radiating unit is inserted into a cavum concha in an auricle of a listener's ear by making effective use of a resiliency of a headband and held therein by a pressing force. As is described in U.S. Pat. No. 4,668,842, this type of headphone includes a housing portion in which an electroacoustic transducer element and a diaphragm are incorporated and a protector member having a large number of sound radiating apertures on the sound radiation surface side of the housing portion.

The above conventional headphone includes the housing portion whose outer shape is matched with those of the electroacoustic transducer element and the diaphragm. Therefore, the shape of the housing portion becomes a flat cylinder. When the housing portion of the above shape is fitted into the cavum concha in the auricle of the listener's ear, the housing portion cannot be closely fitted into the cavum concha appropriately along the shape of cavum concha. When the housing portion of the headphone is fitted into the cavum concha, the listener unavoidably feels physical discomfort. In particular, when the housing portion is fitted into the cavum concha, a part of the housing presses a tragus in the auricle of the listener's ear. There is then the disadvantage that, when the listener wears the headphone for a long period of time, the listener feels pain too strong to permit use of the headphone.

Further, since the housing portion is not closely and appropriately fitted into the cavum concha, sound from the sound radiating portion escapes to the outside of the auricle from a spacing between the cavum concha and the housing portion. As a consequence, acoustic efficiency of the low frequency component is lowered and the escape of the high frequency component is increased, thereby deteriorating the acoustic characteristics of the headphone.

OBJECTS AND SUMMARY OF THE INVENTION

Therefore, it is an object of the present invention to provide an improved headphone in which the aforesaid shortcomings and disadvantages encountered with the prior art can be eliminated.

More specifically, it is an object of the present invention to provide a headphone in which a housing member can be closely and appropriately fitted into cavum concha of the listener's ear.

It is another object of the present invention to provide a headphone in which sound can be prevented from escaping to the outside of an auricle.

It is still another object of the present invention to provide a headphone in which acoustic efficiency can be improved.

According to a first aspect of the present invention, there is provided a headphone which comprises a pair of housing members into which speaker units and diaphragms are accommodated, protector members having sound radiating portions on which a plurality of sound radiating apertures are bored and respectively provided on the pair of housing members at their sound radiation sides from which sound is radiated by a vibration of the diaphragms, and supporting members for supporting the housing members within a cavum concha of an auricle of a listener's ear so that the sound radiating portion is opposed to the entrance of an external auditory meatus in the auricle of the listener's ear, wherein the housing member has a concave portion that is engaged with one portion of the auricle of the listener's ear when the housing member is fitted into the auricle of the listener's ear.

According to a second aspect of the present invention, there is provided a headphone which includes a pair of housing portions in which speaker units and diaphragms are accommodated, and protector portions having sound radiating portions formed of a plurality of sound radiating apertures on sound radiating surface sides of the housing portions wherein the sound radiating portion is fitted into the entrance of an external auditory meatus of a listener's ear in an opposing relation thereto. This headphone comprises hanger portions for supporting the housing portions within a cavum concha in an auricle of the listener's ear so that the sound radiating portion is opposed to the entrance of the external auditory meatus in the auricle of the listener's ear, a headband portion having one and other end portions to which the hanger portions are slidably attached and made of a resilient member, and attachment portions extended from the hanger portions and to which housing portion having speaker units and diaphragms therein are attached, wherein the housing portion has a concave portion formed at a position opposing to an anti-tragus in the auricle of the listener's ear, the concave portion being engaged with a tragus to hold the housing portion within the cavum concha in the auricle of the listener's ear when the housing portion is fitted into the auricle of the listener's ear and the sound radiating portion is provided on the protector portion at its position displaced from a center of the diaphragm to the entrance of the external auditory meatus of the listener's ear.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Embodiments of the present invention will hereinafter be described with reference to the drawings.

Figure 1:
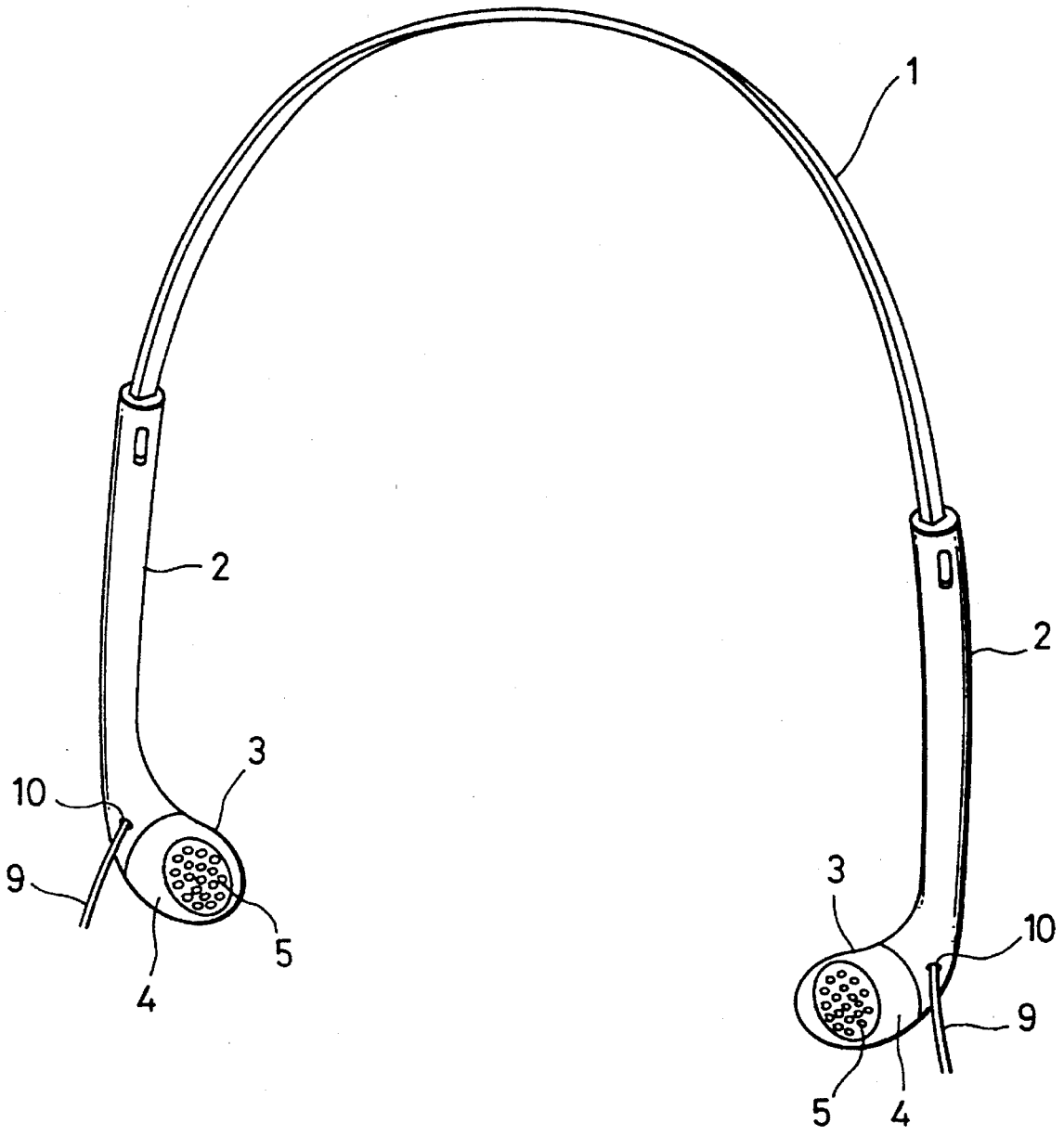
FIG. 1 is a perspective view showing a headphone according to a first embodiment of the present invention.
Figure 2:
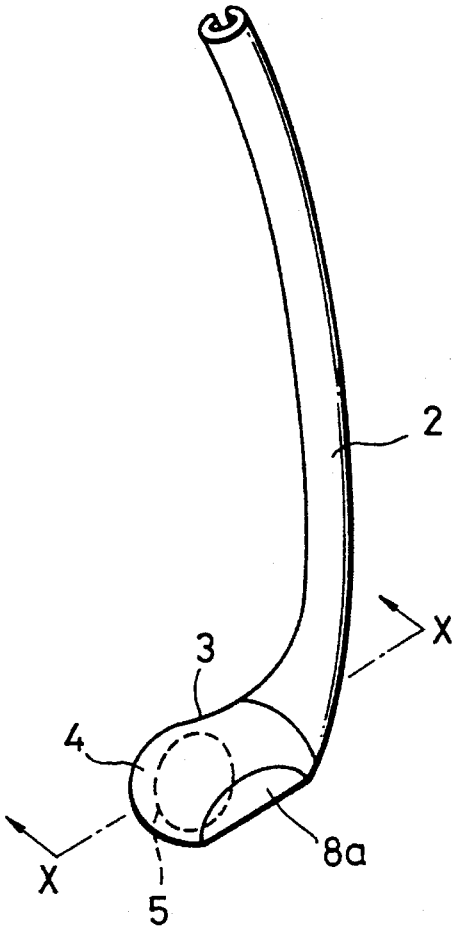
FIG. 2 is a perspective view showing a main portion of the headphone shown in FIG. 1 from the rear side thereof.
Figure 3:
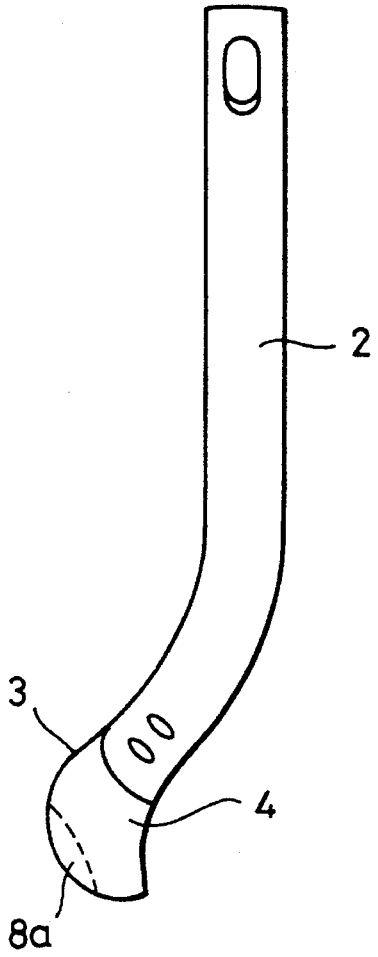
FIG. 3 is a plan view showing a main portion of the headphone shown in FIG. 1 from the lateral side thereof.
Figure 4:
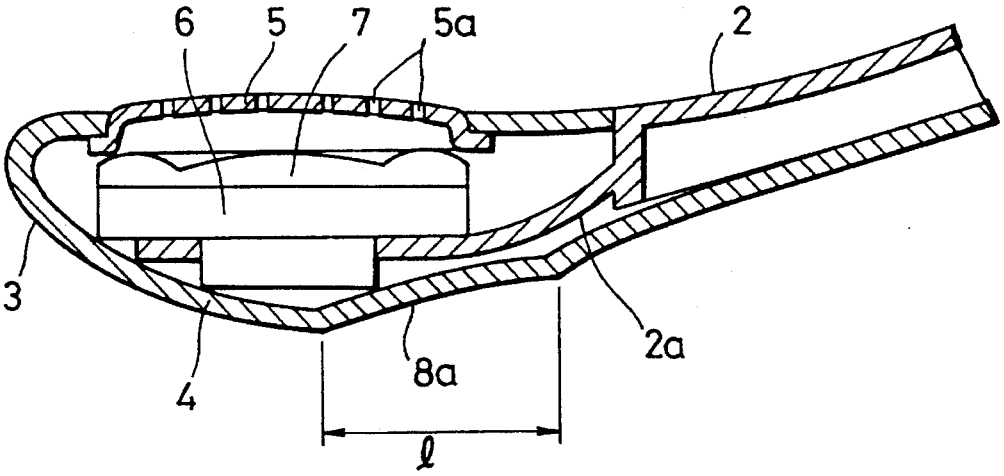
FIG. 4 is a cross-sectional view showing a headphone body shown in FIG. 2 in an enlarged scale.

FIG. 1 of the accompanying drawings shows a headphone according to a first embodiment of the present invention, FIG. 2 is a perspective view showing the rear side of a headphone body, FIG. 3 is a plan view showing the side portion of the headphone body, and FIG. 4 is an enlarged cross-sectional view taken along the line X—X in FIG. 2.

Throughout FIGS. 1 to 4, reference numeral 1 depicts a headband of an arcuate configuration that is formed of a resilient member such as a metal or the like. Hangers 2, 2 are attached to respective ends of the headband 1, and the respective ends of the headband 1 are fitted into the insides of the hangers 2, 2. The hangers 2, 2 are attached to the headband 1 so that they can be slide freely relative to the headband 1. Therefore, the length of the headband 1 can be adjusted by sliding the hangers 2, 2. The two hangers 2, 2 have headphone bodies 3, 3 of outer configurations coincident with the hangers 2, 2 formed on their top portions on the sides opposite to the sides into which the headband 1 are inserted. That is, the headphone bodies 3, 3 are respectively supported by the headband 1 and the hangers 2, 2 that serve as supporting members. The two hangers 2, 2 have cord insertion apertures 10, 10 bored near the positions at which the headphone bodies 3, 3 are attached. Cords 9, 9 connected to speaker units 6, 6 that will be described later on so as to supply an electrical signal to the speaker units 6, 6 are respectively inserted into the cord insertion apertures 10, 10.

The headphone body 3 comprises a housing 4 supported to the hanger 2 and a protector member 5 formed on one portion of the housing 4. The protector member 5 has bored therethrough a large number of small apertures 5*a* serving as sound radiating portions. An acoustic signal is radiated to the outside from these small apertures 5*a* bored through the protector member 5. The protector member 5 is formed by a press treatment of a metal plate so as to have the small apertures 5*a* or by processing thin wire materials in a net-like shape so as to have the small apertures 5*a*. Further, the protector member 5 may be formed unitarily with the housing 4 by some suitable means such as an integral molding or the like. As shown in FIG. 4, the headphone body 3 accommodates therein the speaker unit 6 and a diaphragm 7 disposed on the front surface side of the speaker unit 6 in an opposing relation to the protector member 5. The diaphragm 7 is driven by the speaker unit 6. The speaker unit 6 and the diaphragm 7 are attached to an attachment plate 2*a* elongated from the hanger 2. The speaker unit 6 and the diaphragm 7 are supported by the hanger 2 so that they face the forward side (listener's face side) when the listener wears the headband 1 on the head to fit the headphone bodies 3 into the listener's ears. The hangers 2 are curved so that the diaphragm 7 is located in substantially the same plane direction as the listener's face.

Figure 5A:
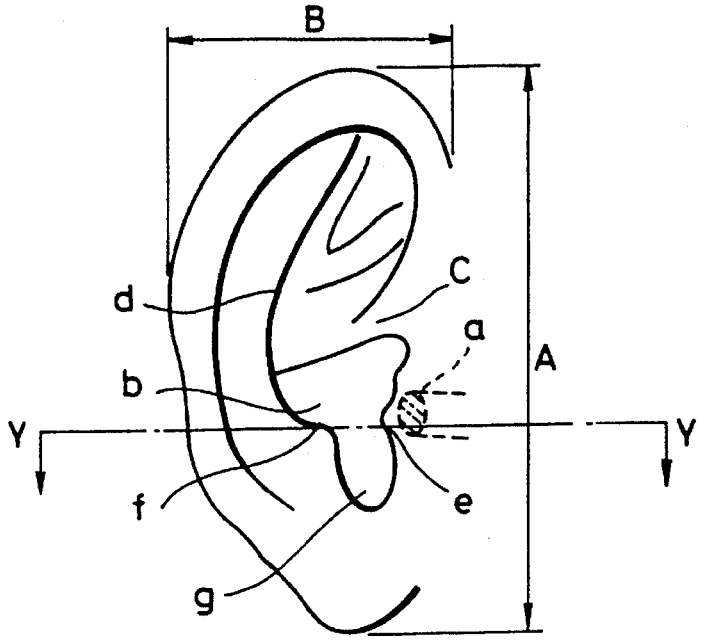
FIGS. 5A, 5B and 5C are respectively diagrams showing dimensions of respective portions of listener's ear.
Figure 5B:
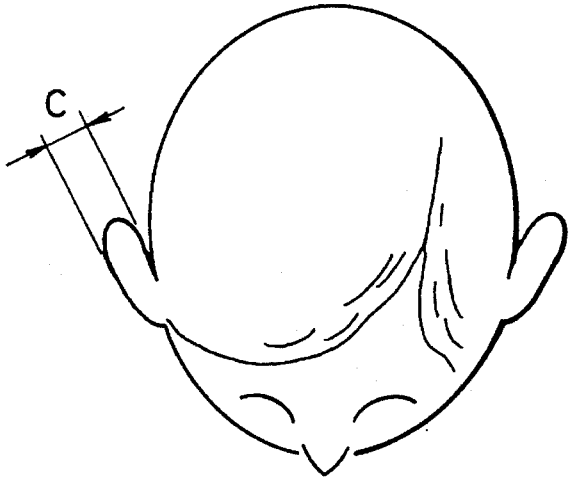
Figure 5C:
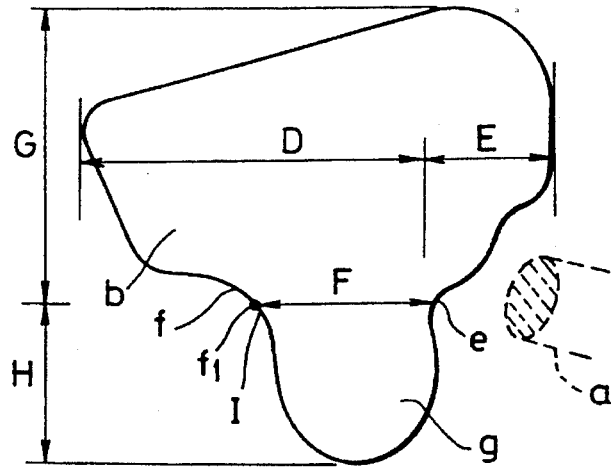

The outer appearance or shape of a human ear will be described next with reference to FIGS. 5A through 5C. FIG. 5A is a front view showing the entirety of a human ear, FIG. 5B is a diagram showing a thickness of the human ear from the top of a human head, and FIG. 5C is a front view showing a cavum concha b portion in an enlarged scale. As shown in FIG. 5A, as the common shape of the auricle of a human ear, there is a recess of a substantially circular truncated cone, i.e., a so-called cavum concha b at the forward side surface of which the entrance of an external auditory meatus a lies from the side of the human head to the front of the human face. Around the cavum concha b, there are a helix leg c and an antihelix d. A tragus e lies on the base of the side of human head, and an antitragus f covers the cavum concha b and the entrance of the external auditory meatus a together with the tragus e. Between the tragus e and the anti-tragus f, there is a so-called inter-tragus notch g so as to form a spacing of substantially U-shape.

Shapes and sizes of listener's ears are different, dependent upon particular users and also upon the sex of the users. To obtain the best shape of the housing 4 of the headphone so that the housing 4 of the headphone may be appropriately fitted into listener's ear, the inventors measured shapes and sizes of ears of a plurality of male users and a plurality of female users with respect to sizes A to I of respective portions of the human ear shown in FIGS. 5A, 5B and 5C. The following table 1 indicates average values of the measured values of these sizes A through I.

TABLE 1

| | Average Values (mm) | |
|---|---|---|
| | Male (56 persons) | Female (13 persons) |
| A | 66.2 | 62.2 |
| B | 35.3 | 33.1 |
| C | 20.0 | 16.9 |
| D | 13.5 | 12.7 |
| E | 3.0 | 2.8 |
| F | 7.9 | 7.5 |
| G | 8.6 | 7.3 |
| H | 7.2 | 7.3 |
| I | 10.2 | 9.2 |

Of the measured portions of the human ear, the most important portion is the cavum concha b into which there is fitted the housing 4 of the headphone. More specifically, most important measured values are the length F between the tragus e and the anti-tragus f in the cavum concha b, the length H from the anti-tragus f to the inter-tragus notch g and the depth I of the cavum concha b at a point $f_1$ of the anti-tragus f. When the housing 4 is shaped so as to match with the sizes F, H and I based on the average values, the listener can fit the housing 4 of the headphone into the ear without feeling any pain at all.

Figure 6:
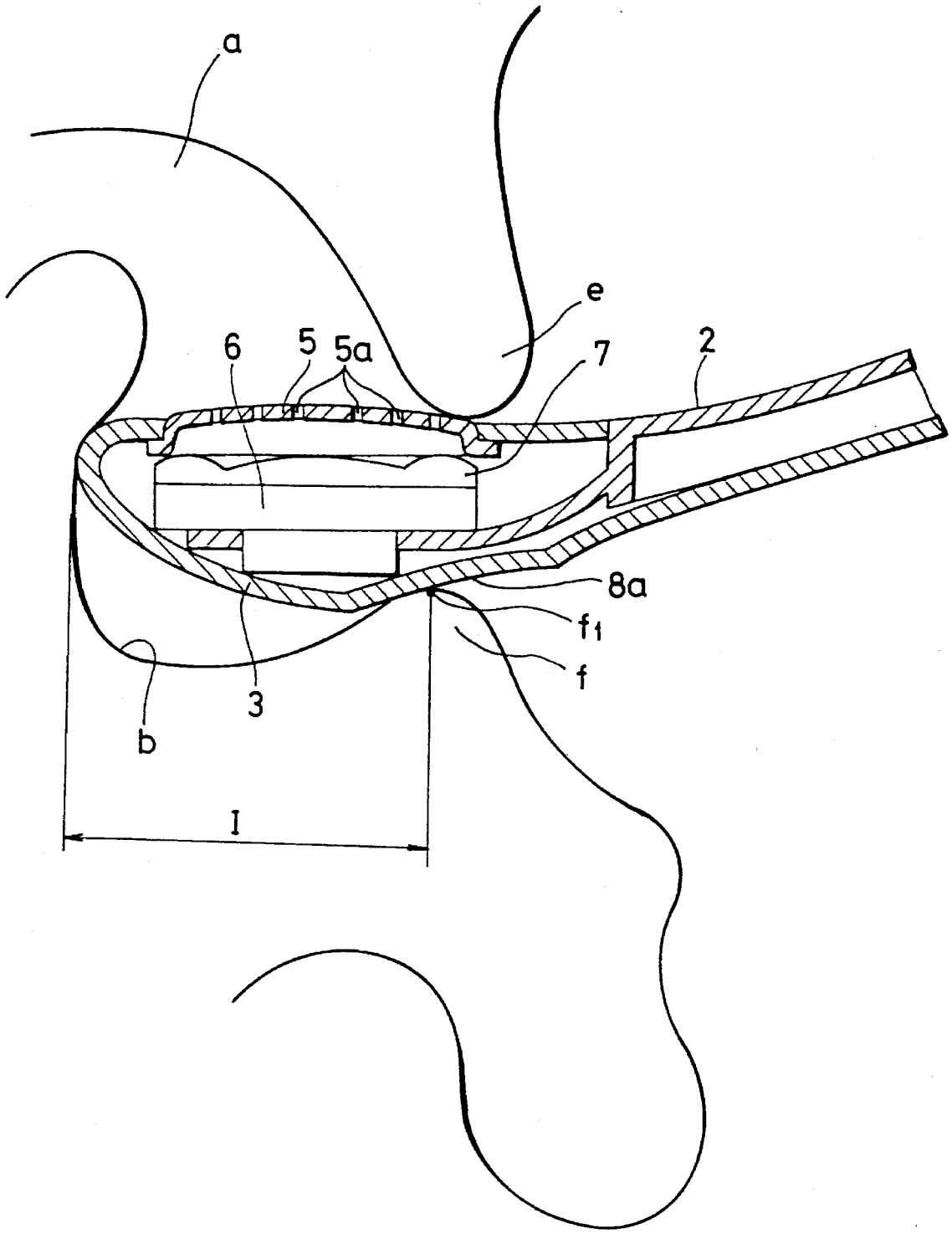
FIG. 6 is an enlarged cross-sectional view showing the headphone shown in FIG. 1 fitted into the listener's ear.

FIG. 6 is an enlarged cross-sectional view taken along the line Y—Y in FIG. 5A and showing the condition that the headphone body 3 thus arranged is fitted into the auricle of listener's ear. The housing 4 has a concave portion 8*a* formed at the lower opposite portion of the acoustic radiation direction side in which the protector member 5 is located in association with the anti-tragus f that is a part of the auricle of listener's ear, thereby to prevent the anti-tragus f from being pressed by the housing 4 of the headphone. The position and depth of the concave portion 8*a* is determined on the basis of mainly the depth I (see the above table 1) of the cavum concha b at the point $f_1$ of the anti-tragus f. Average values of the depth I of adult men and women are respectively 10.2 mm and 9.2 mm as shown on the table 1. Therefore, it is preferred that the concave portion 8*a* formed at the position distant from the top portion of the housing 4 of the headphone be 9.2 mm to 10.2 mm. Study of measured results of the depth I reveals that one person (male) has the minimum depth I in a range of from 6.5 mm to 7.4 mm and one person (male) has the maximum depth I in a range of from 13.5 mm to 14.4 mm. From this, it is preferred that a width l of the concave portion 8*a*, i.e., the length of the cavum concha b in the depth direction be selected to be longer than at least 8 mm. In the headphone according to this embodiment, the concave portion 8*a* formed on the housing 4 is formed as a spherical-shaped concave portion having a radius of 20 mm in which the width l is 12 mm at maximum. The shape of the concave portion 8*a* is not limited to the spherical shape. The concave portion 8*a* may be formed of a part of the curved surface such as an ellipsoidal surface, a cylindrical surface or the like or formed by a combination of planes. Having considered the size of the speaker unit 6 incorporated into the housing 4, it is preferred that the depth of the concave portion 8*a* from the surface of the housing 4 be in a range of from about 1 mm to 3 mm.

The shapes and sizes of the speaker unit 6 and the diaphragm 7 accommodated into the housing 4 are also determined on the basis of the above numerical values F, H and I. In this embodiment, the speaker unit 6 has diameters of 13.5 mm and 16 mm because the speaker unit having a diameter of larger than 20 mm or less than 12 mm either cannot be accommodated within the housing 4 or desired acoustic characteristics (reproduced frequency characteristics) cannot be obtained.

The hanger 2 supports the headphone body 3 having the housing 4 thus arranged so that the speaker unit 6 and the diaphragm 7 are opposed to the entrance of the external auditory meatus a of the listener's ear. When the headphone body 3 is fitted into the cavum concha b of the listener's ear, the concave portion 8*a* formed on the housing 4 opposes the anti-tragus f to protect the anti-tragus f from being pressed by the housing 4. Also, when the concave portion 8*a* contacts with the anti-tragus f, the headphone body 3 is positioned such that the speaker unit 6 and the diaphragm 7 are reliably opposed to the entrance of the external auditory meatus a of the listener's ear.

The headphone of the present invention is arranged as described above. Therefore, when the listener fits the headphone body 3 into the cavum concha b in the auricle of the listener's ear, the housing 4 can be closely and appropriately fitted into the ear along the shapes of the tragus e, the anti-tragus f and the cavum concha b so that the user of the headphone does not feel pain. Thus, sound radiated from the protector member 5 can be prevented from escaping to the outside of the auricle and can be efficiently introduced into the external auditory meatus a, whereby acoustic efficiency of, in particular, a low frequency component can be increased.

Since the concave portion 8*a* that is engaged with a part of the auricle of the listener's ear when the user of the headphone wears the headphone is formed on the housing 4, the anti-tragus f can be protected from being pressed by the housing 4 fitted into the cavum concha b. Thus, the user of the headphone does not feel pain, permitting use of the headphone for a long period of time.

Figure 7A:
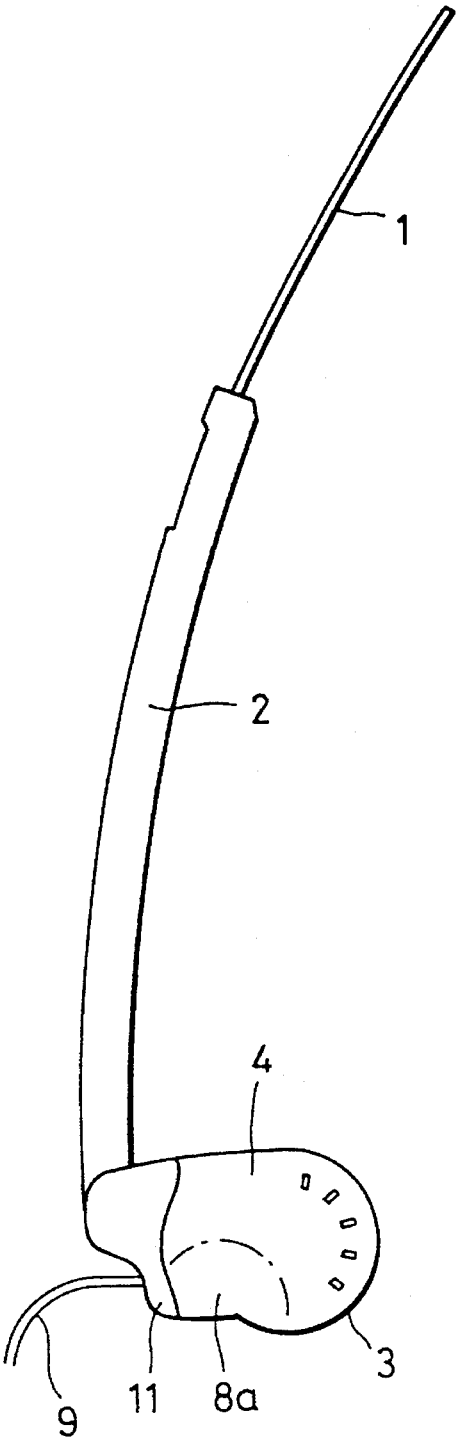
FIGS. 7A, 7B and 7C are diagrams showing the headphone according to a second embodiment of the present invention, respectively.
Figure 7B:
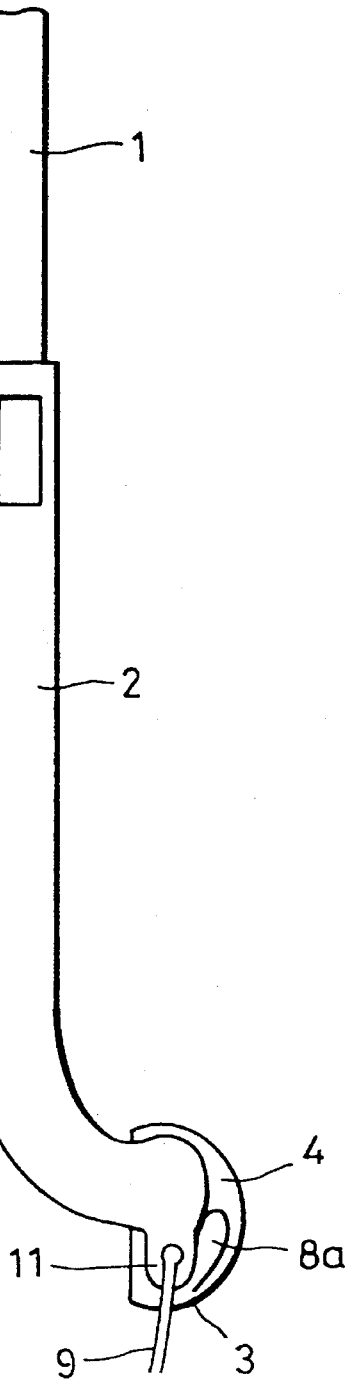
Figure 7C:
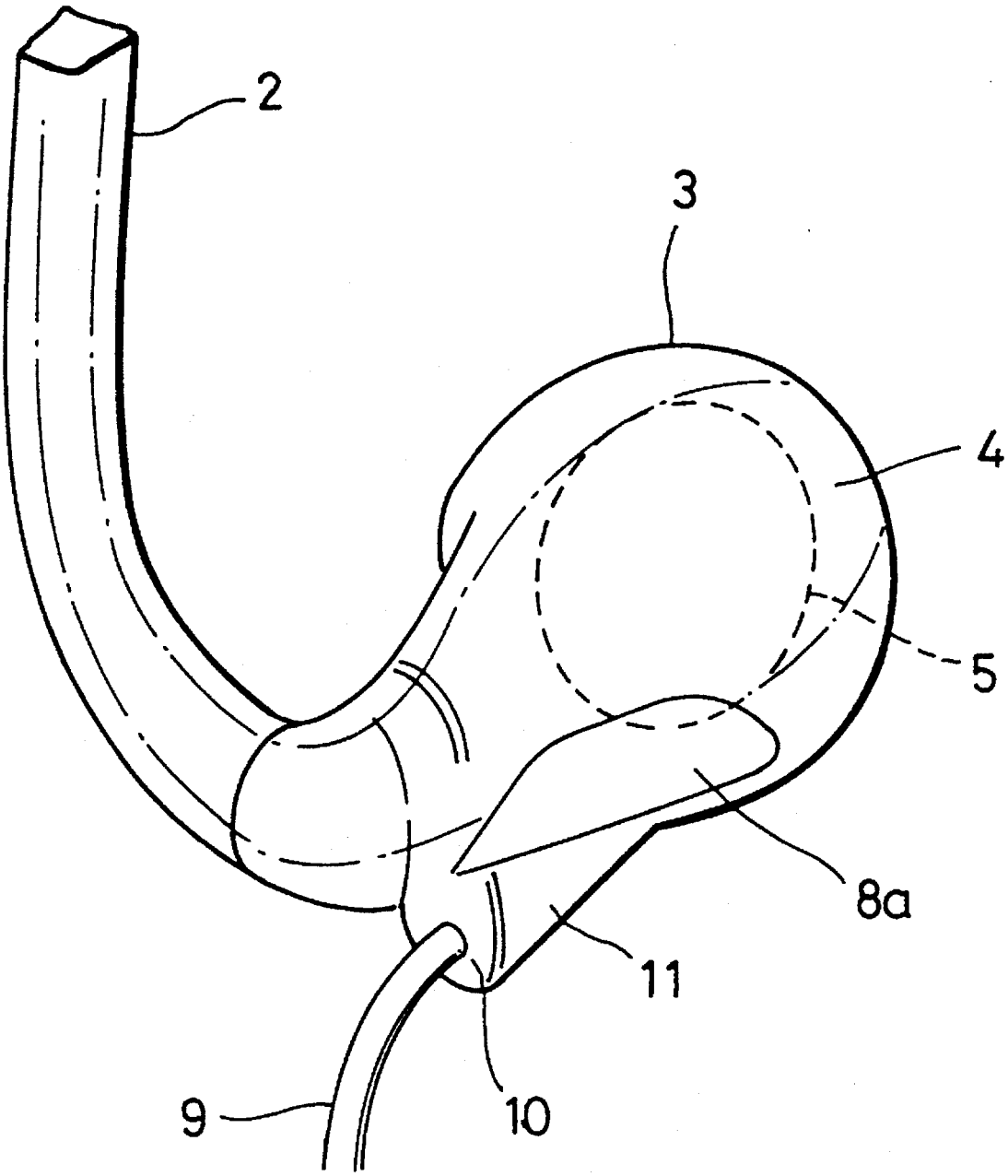

The headphone according to a second embodiment of the present invention will be described with reference to FIGS. 7A through 7C. FIG. 7A is a plan view showing the rear portion of the headphone body, FIG. 7B is a plan view showing the side portion of the headphone body and FIG. 7C is a perspective view showing a main portion of the headphone body. In FIG. 7A through 7C, like parts corresponding to those of FIGS. 1 to 6 are marked with the same references and therefore need not be described in detail.

As shown in FIG. 7A, the housing 4 has the concave portion 8*a* formed at the lower position on the rear side thereof, i.e., on the opposite side of the sound radiation surface, i.e., at the position opposite to the side in which the hanger 2 is extended. The concave portion 8*a* is opposed to the anti-tragus f of the listener's ear when the user fits the headphone body 3 into the cavum concha b, thereby protecting the anti-tragus f from being pressed by the housing 4. The housing 4 is substantially hemispherical in shape at a portion in which the housing 4 is fitted into the auricle of the ear except for the concave portion 8*a* as shown in FIG. 7B. The hanger 2 that supports the housing 4 is unitarily formed with the end portion on the side opposite to the side into which the housing 4 is fitted. When the user of the headphone wears the headphone, the hanger 2 is extended forwardly from the headphone body 3, progressively curved, changed in its extending direction substantially 90° and then upwardly extended along the shape of the user's head. According to the aforesaid arrangement of the headphone, since the hanger 2 can be prevented from contacting the auricle of the listener's ear, the auricle can be prevented from being pressed and the user of the headphone can wear the headphone comfortably. As shown in FIG. 7C, the housing 4 has a cord leading portion 11 formed near the lower side of the attachment portion of the hanger 2. From the cord leading portion 11, the cord 9 that is used to supply an electrical signal to the speaker unit 6 incorporated within the housing 4 is extended in the same direction as the extending direction of the hanger 2, i.e., in the direction opposite to the direction in which the housing 4 is fitted into the cavum concha b. The cord 9 is extended in the above-mentioned direction so that, when the user of the headphone wears the headphone, the user of the headphone can be prevented from being annoyed with the cord 9 on the cheek. Thus, the user of the headphone can be protected from unpleasantness.

The headphone according to a third embodiment of the present invention will hereinafter be described with reference to FIGS. 8 to 12. In FIGS. 8 to 12, like parts corresponding to those of the first and second embodiments are marked with the same references and therefore need not be described in detail.

Figure 8:
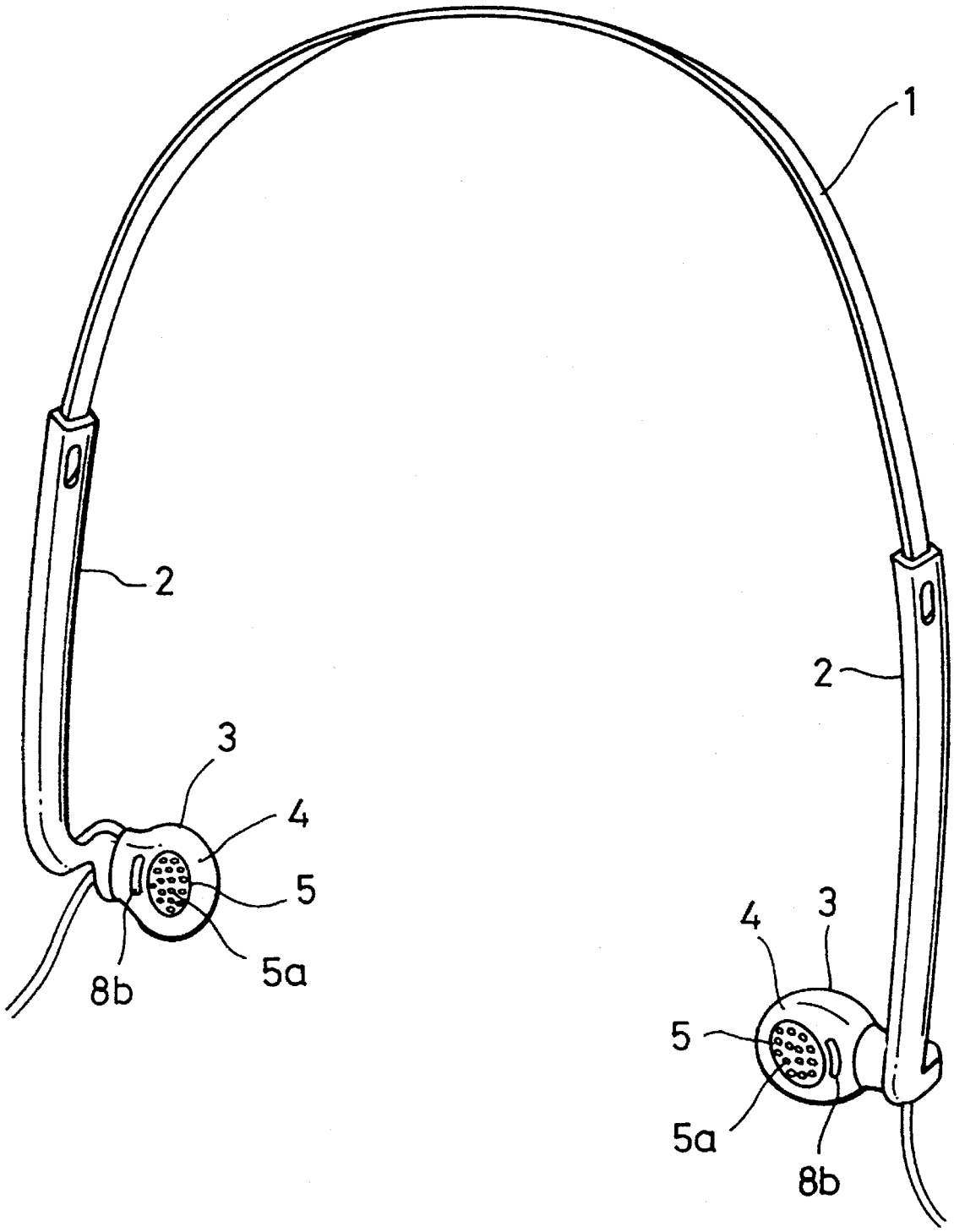
FIG. 8 is a perspective view showing the headphone according to a third embodiment of the present invention.
Figure 9:
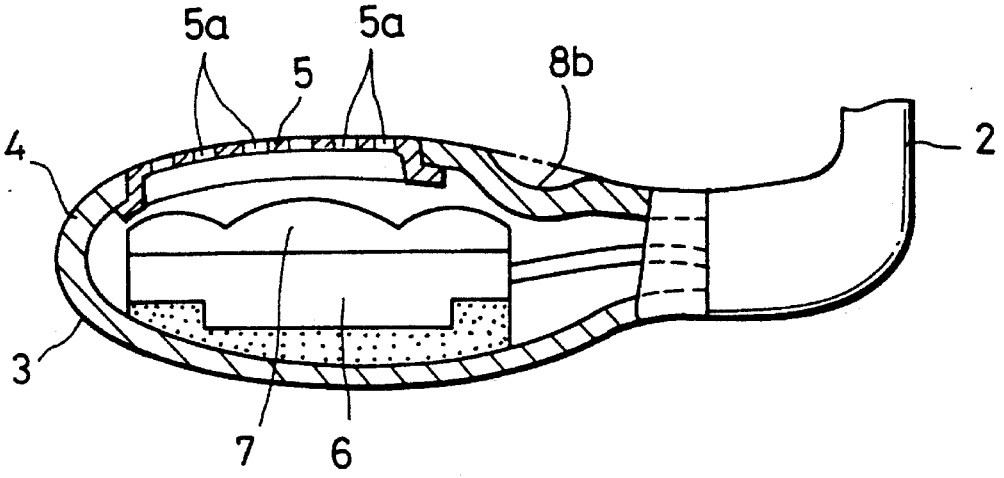
FIG. 9 is a cross-sectional view showing a main portion of the headphone shown in FIG. 8 in an enlarged scale.

FIG. 8 shows a perspective view of the entirety of the headphone and FIG. 9 shows a cross-sectional view of the headphone body. As shown in FIG. 8, the hangers 2, 2 are curved so that the sound radiation apertures 5*a* bored through the protector member 5 so as to construct the sound radiating portion are directed in the same direction as the face of the user of the headphone when the headphone body 3 is fitted into the auricle of the listener's ear, i.e., the user of the headphone wears the headband 1 on the head so as to oppose the protector member 5 of the headphone body 3 to the entrance of the external auditory meatus a. The protector member 5 on which the sound radiating apertures 5*a* are formed is substantially the same in area as that of the entrance of the external auditory meatus a in the auricle of the user's ear. Also, when the housing 4 is held in the cavum concha b, the position of the protector member 5 is displaced to the entrance of the external auditory meatus a from the center of the diaphragm 7 and the portion except the protector member 5 having the sound radiating apertures 5*a* is covered with the housing 4.

Figure 10:
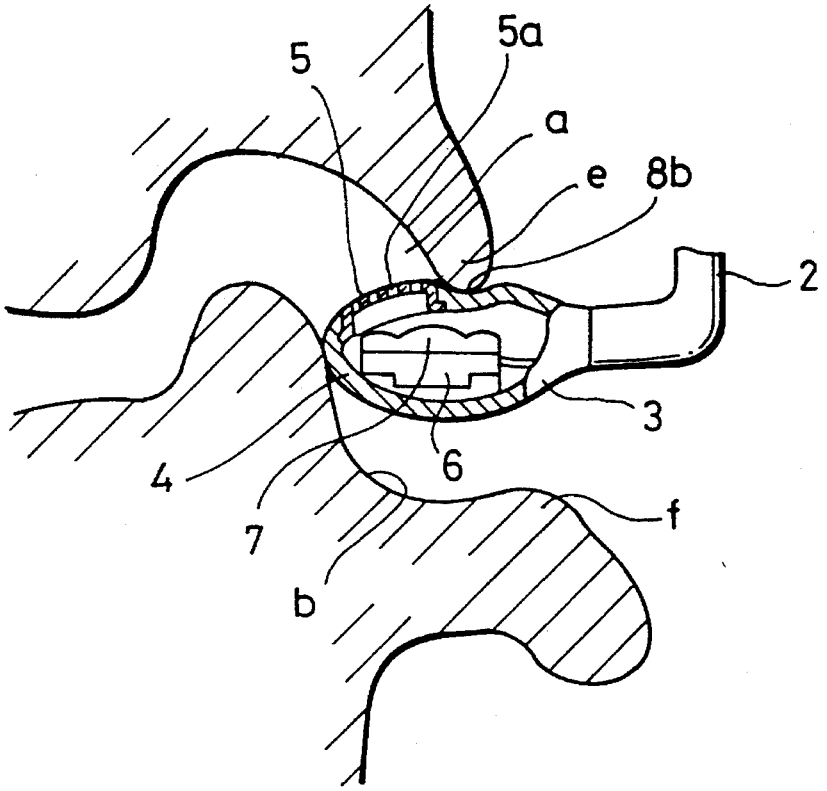
FIG. 10 is an enlarged cross-sectional view showing the condition that the headphone shown in FIG. 9 is fitted into the listener's ear.
Figure 11:
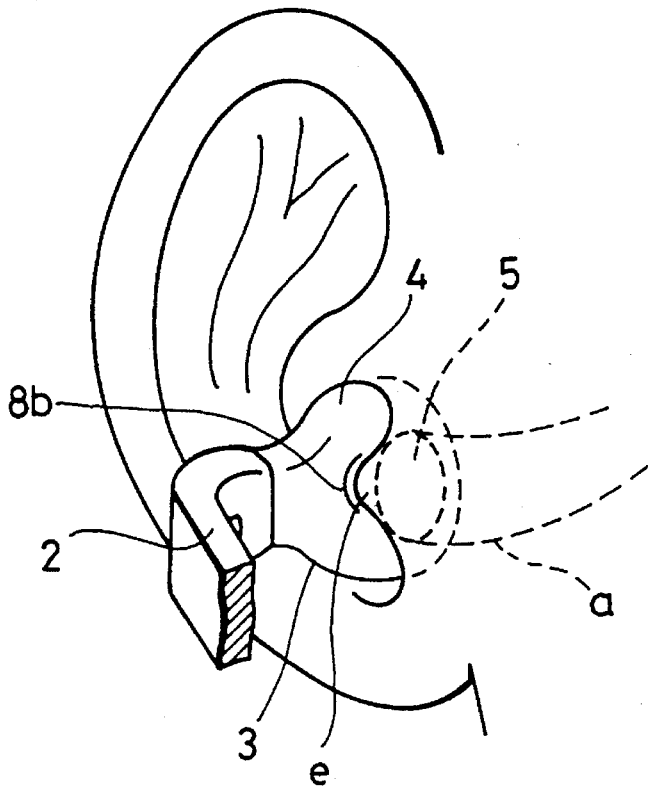
FIG. 11 is a perspective view showing the headphone shown in FIG. 9 fitted into the listener's ear.

FIG. 10 is a cross-sectional view showing the headphone body 3 of the headphone fitted into the cavum concha b, and FIG. 11 is a perspective view showing the headphone body 3 of the headphone fitted into the cavum concha b. According to the headphone thus arranged, since sound radiated from the sound radiating apertures 5*a* of the protector member 5 can be prevented from escaping to the outside of the auricle of the listener's ear and can be fully introduced from the entrance of the external auditory meatus a into the external auditory meatus a, acoustic transmissibility of the headphone according to the present invention can be improved, in particular, a high frequency component having a strong directivity can be efficiently introduced into the external auditory meatus a of the listener's ear.

Further, in the headphone according to the present invention, the position that the sound radiating apertures 5*a* that are bored through the protector member 5 of the housing 4 are displaced from the center of the diaphragm 7 to the entrance side of the external auditory meatus a of the listener's ear and the remaining portion except the protector member 5 is covered with the housing 4. Therefore, sound radiated from the diaphragm 7 is converged. Study of an acoustic characteristic graph of FIG. 12 reveals that ranges of voices of intermediate and low frequency components can be efficiently introduced into the external auditory meatus a of the listener's ear.

Furthermore, according to the headphone of the present invention, the concave portion 8*b* is formed on the predetermined portion of the housing 4 that covers the diaphragm 7 in an opposing relation to the tragus e in the auricle of the listener's ear. Therefore, when the user of the headphone fits the headphone body 3 into the cavum concha b, the concave portion 8*b* is closely brought in contact with the tragus e so that the tragus e is not pressed by the housing 4. Thus, the user of the headphone can use the headphone for a long period of time without feeling pain. Also, since the housing 4 and the cavum concha b are brought in contact with each other more closely, sound from the radiating apertures 5*a* can be prevented from escaping to the outside more reliably. If necessary, the concave portion 8*a* may be provided on the housing 4 on a side opposite to the concave portion 8*a* in an opposing relation to the anti-tragus f of the auricle of the listener's ear.

Figure 13:
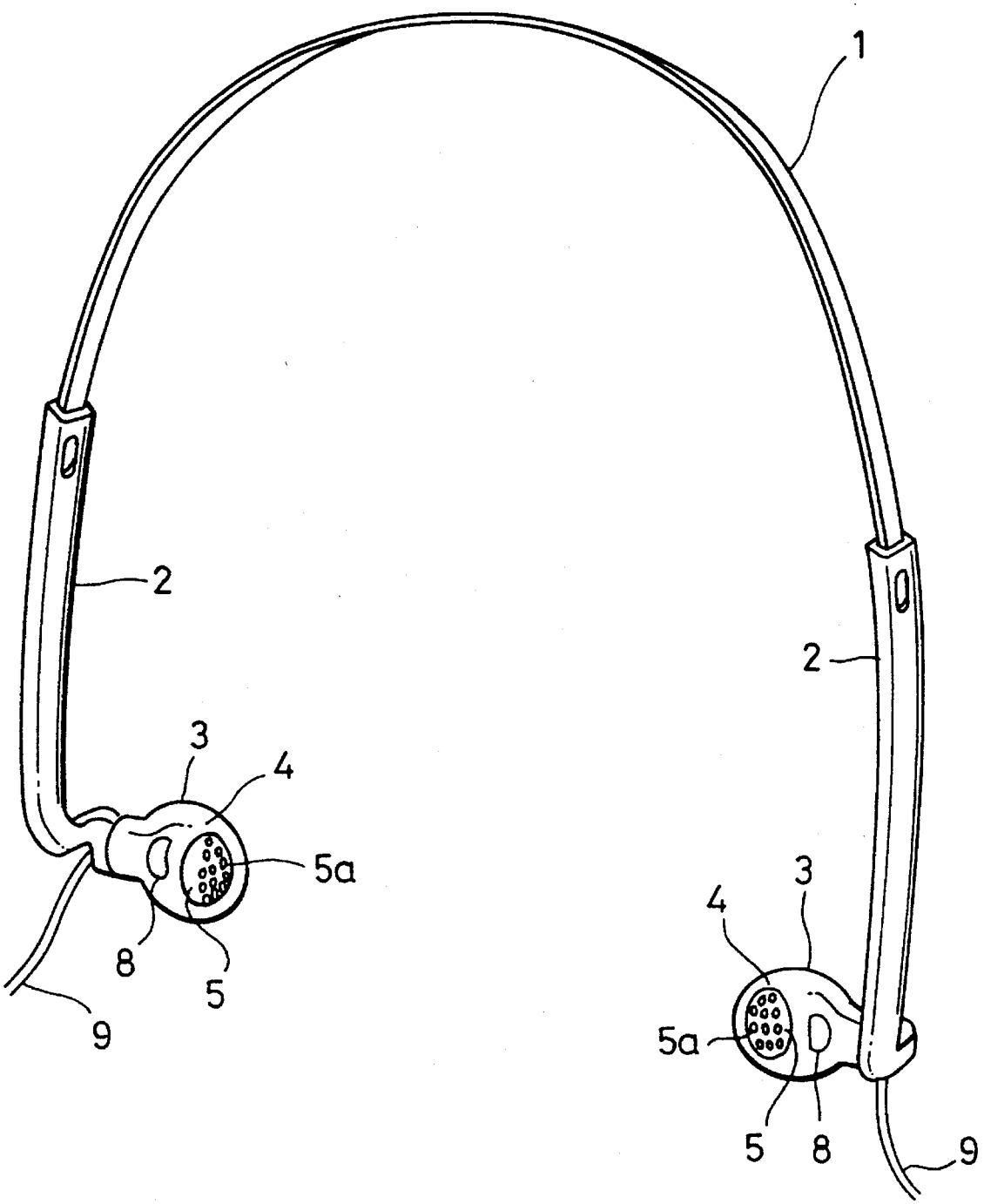
FIG. 13 is a perspective view showing the headphone according to a fourth embodiment of the present invention.

The headphone according to a fourth embodiment of the present invention will hereinafter be described with reference to FIGS. 13 and 14. FIG. 13 is a perspective view showing the entirety of the headphone and FIG. 14 is a cross-sectional view showing the headphone body 3.

Figure 14:
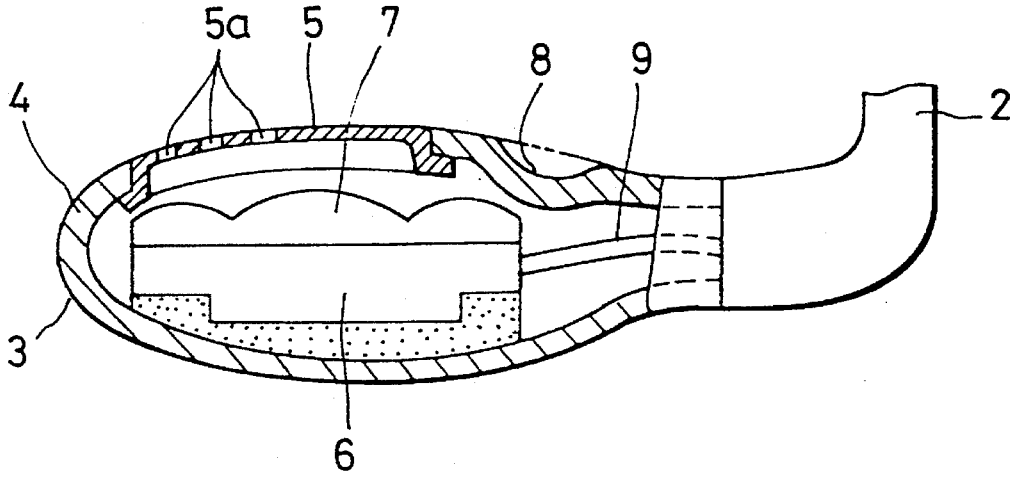
FIG. 14 is a cross-sectional view showing a main portion of the headphone shown in FIG. 13.
Figure 12:
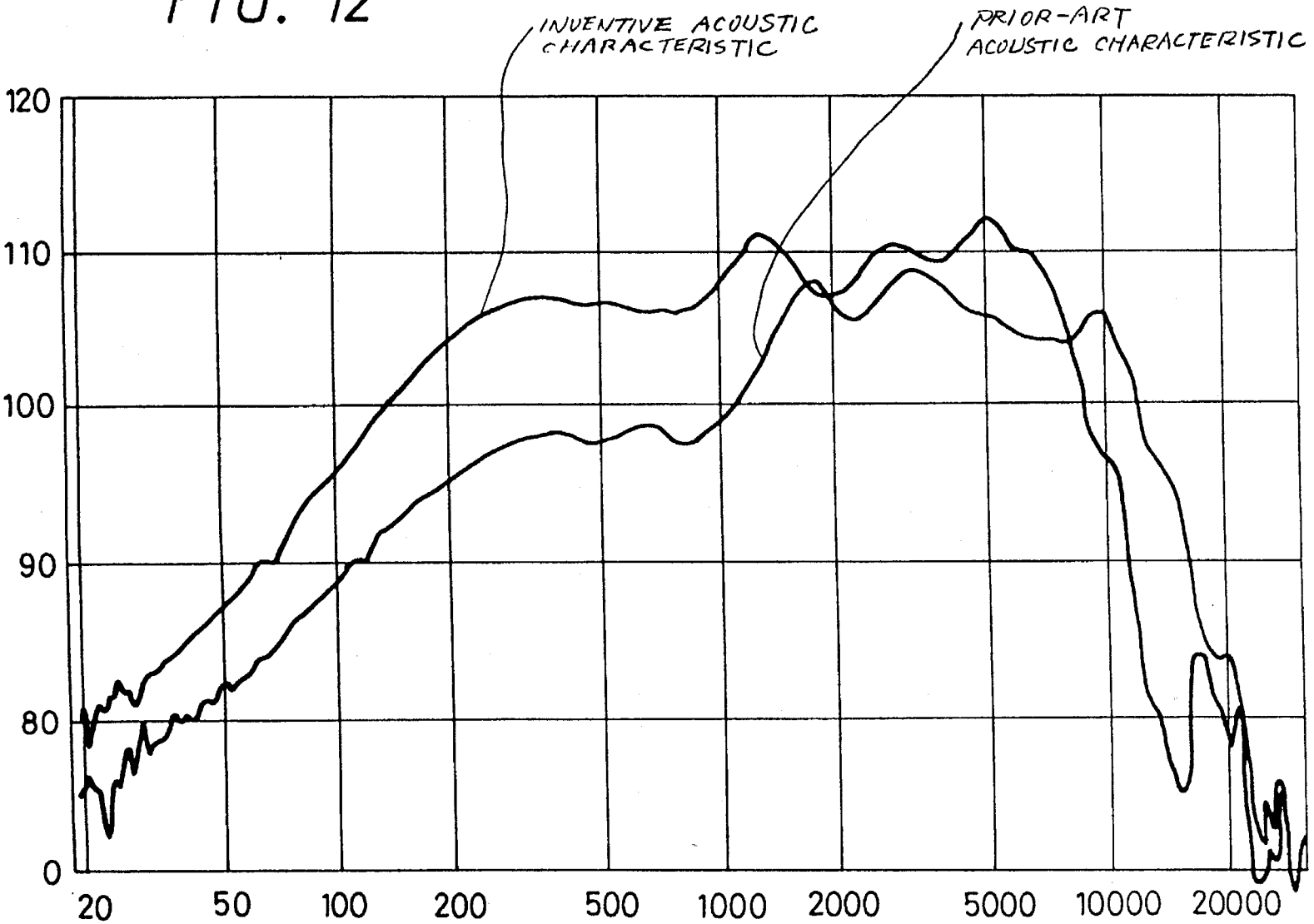
FIG. 12 is a characteristic graph showing acoustic output characteristics of the headphone of the present invention and the prior-art headphone.

In the headphone shown in FIGS. 13 and 14, under the condition that the user of the headphone fits the headphone body 3 into the cavum concha b, the sound radiating apertures 5*a* are provided on the protector member 5 at its position displaced to the entrance side of the external auditory meatus a. According to this structure, a sound radiated from the diaphragm 7 can be converged more. Therefore, a sound radiated from the sound radiating apertures 5*a* can be prevented from escaping to the outside. There is then the advantage that the range of voices of intermediate and low frequency components can be more efficiently introduced into the external auditory meatus a of the listener's ear.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A headphone comprising:

a pair of housing members, each housing member accomodating a speaker unit and a diaphragm;

a pair of protector members each having a sound radiating portion in which a plurality of sound radiating apertures are bored, one protector member being respectively provided on each of the pair of housing members at a sound radiating side thereof from which sound is radiated by a vibration of the diaphragm, each protector member being formed of a substantially rigid material; and supporting members for respectively supporting each of the housing members within a cavum concha of an auricle of a listener's ear so that the sound radiating portion faces an entrance of an external auditory meatus in the auricle of the listener's ear, wherein each housing member has a concave portion having a predetermined position and depth thereon relative to the contour of the listener's ear such that a portion of the auricle of the listener's ear engages the inner curved surface of the concave portion when the housing member is fitted into the auricle of the listener's ear, a central axis of the protector member is displaced from a central axis of the diaphragm toward the entrance of an external auditory meatus of the listener's ear when each housing member is held within a respective cavum concha in the auricle of the listener's ear, and the concave portion is formed on each housing member on the sound radiating side at a position for engaging the tragus in the auricle of the listener's ear.

2. The headphone according to claim 1, in which the supporting members include a flexible headband having ends and a hanger portion provided on each end of the headband for supporting the housing members so that the sound radiating portions of the protector members are facing in the same direction relative to a listener's face.

3. The headphone according to claim 2, in which each housing member includes a cord lead-out portion through which a cord is connected to the speaker unit to supply an electrical signal to the speaker unit, the cord having a segment adjacent the speaker unit and extending in a direction opposite to the direction in which the housing member is fitted into the auricle of the listener's ear.

* * * * *